United States Patent [19]

Satou

[11] Patent Number: 4,851,073

[45] Date of Patent: Jul. 25, 1989

[54] APPARATUS FOR CONNECTING TILES IN SETS

[75] Inventor: Toshinori Satou, Tajimi, Japan

[73] Assignee: Satou Kagaku Kougyou Kabushiki Kaisha, Tajimi, Japan

[21] Appl. No.: 10,406

[22] Filed: Feb. 3, 1987

[51] Int. Cl.[4] ..... B32B 31/18

[52] U.S. Cl. ..... 156/516; 156/517; 156/560; 156/561

[58] Field of Search ..... 156/497, 516, 517, 560, 156/561, 521; 52/384, 386, 390, 391, 747

[56] References Cited

U.S. PATENT DOCUMENTS

| | | | |
|---|---|---|---|
| 2,797,010 | 6/1957 | Neer | 156/561 |
| 2,844,955 | 7/1958 | Talbott | 52/391 |
| 3,113,900 | 12/1963 | Abernethy et al. | 156/560 |
| 3,192,097 | 6/1965 | Abernethy | 156/63 |
| 3,255,067 | 6/1966 | Suntheim et al. | 156/521 |
| 3,346,433 | 10/1967 | Lopez | 156/521 |
| 3,376,185 | 4/1968 | Shook et al. | 156/552 |
| 3,909,342 | 9/1975 | Shook | 52/384 |

FOREIGN PATENT DOCUMENTS

| | | | |
|---|---|---|---|
| 0070928 | 2/1983 | France | 52/384 |

*Primary Examiner*—Caleb Weston

*Attorney, Agent, or Firm*—Robert E. Burns; Emmanuel J. Lobato

[57] ABSTRACT

A plurality of tiles arranged as a set the same as are pasted onto a wall or floor are integrally connected with one another by pasting rectangular connecting pieces made of such sheet materials as of paper, cloth or resin film onto the back surfaces of the tiles to bridge two adjacent tiles with each other. The connecting pieces are obtained by cutting fixed lengths off the long tape-shaped materials. The connecting pieces thus cut off are sucked by suckers, are fed to a set of tiles conveyed as mounted as inverted on a conveyor and are pasted by a bonding agent onto the back surfaces of two adjacent tiles to bridge them with each other.

7 Claims, 4 Drawing Sheets

APPARATUS FOR CONNECTING TILES IN SETS

BACKGROUND OF THE INVENTION (a) Field of the Invention:

This invention relates to connected tiles made by connecting a plurality of ceramic tiles adjacently with one another on the back surfaces so as to be bonded set by set onto a floor surface or wall surface and a method and apparatus for connecting tiles with one another.

(b) Description of the Prior Art:

In the case of bonding ceramic tiles onto a floor surface or wall surface of a building, if they are bonded one by one, the bonding efficiency will be low and it will be difficult to correctly arrange them. Therefore, there is generally adopted a working method wherein several or 10 to 20 tiles are arranged the same as are bonded by using an arranging frame, are connected integrally with one another as a set by pasting sheet-shaped or net-shaped connecting pieces with a bonding agent on the back surface or front surface of the set and are bonded set by set in turn on the spot. In the case of connecting such tiles with one another by pasting connecting pieces on the back surfaces of the tiles, as mentioned in the gazette of Japanese utility model publication No. 25064/1980, there are used four tiles integrally connected with one another by pasting a connecting piece having a through hole formed in the center onto the collecting part of the respective corners of the tiles. However, the connecting piece having a through hole formed in the center has defects that it must be made by punching a sheet material, is low in the rate of yield, requires an equipment on a large scale in punching, is low in the working efficiency and is high in the production cost and that, in case the tile has concaves and convexes formed on the back surface to elevate the bonding strength onto the bonding surface, the connecting piece will float up in a part from the concaves on the back surface of the tile to reduce the bonding force.

SUMMARY OF THE INVENTION

The connected tiles of the present invention have it as a subject matter that a plurality of tiles are arranged as a set the same as are bonded and are integrally connected with one another by pasting rectangular connecting pieces made of such sheet materials as of paper, cloth or resin film onto the back surfaces of the tiles to bridge the two adjacent tiles with each other. The connecting pieces are rectanguler, are pasted onto the back surfaces of two adjacent tiles to bridge them with each other and therefore have advantages that they can be simply made by cutting long sheet materials of fixed widths so as to be of fixed lengths without producing punching scraps, are high in the rate of yield, are very low in the production cost and are also very low in the cost of the connected tiles.

The method of connecting tiles of the present invention has it as a subject matter that connecting pieces of fixed lengths are cut off such long tape-shaped materials as of paper, cloth or resin film, are shifted onto the back surface of a set of a plurality of tiles arranged the same as are bonded and are pasted onto the back surfaces of two adjacent tiles to bridge them with each other. The apparatus for connecting tiles of the present invention has it as a subject matter that, near a conveyer for conveying in one direction a plurality of tiles as mounted as a set as inverted as arranged the same as are bonded, there are set feeding devices for cutting connecting pieces of fixed lengths off such long tape-shaped materials as of paper, cloth or resin film and feeding them and pasting devices for sucking the connecting pieces, conveying them onto the above mentioned conveyer and pasting them onto the back surfaces of two adjacent tiles of the above mentioned set to bridge them with each other. As the respective connecting pieces are cut off the long tape-shaped materials and are shifted onto the back surfaces of the tiles so as to be pasted, the above mentioned connected tiles can be made efficiently.

DESCRIPTION OF THE PREFERRED EMBODIMENTS

Figure 1:
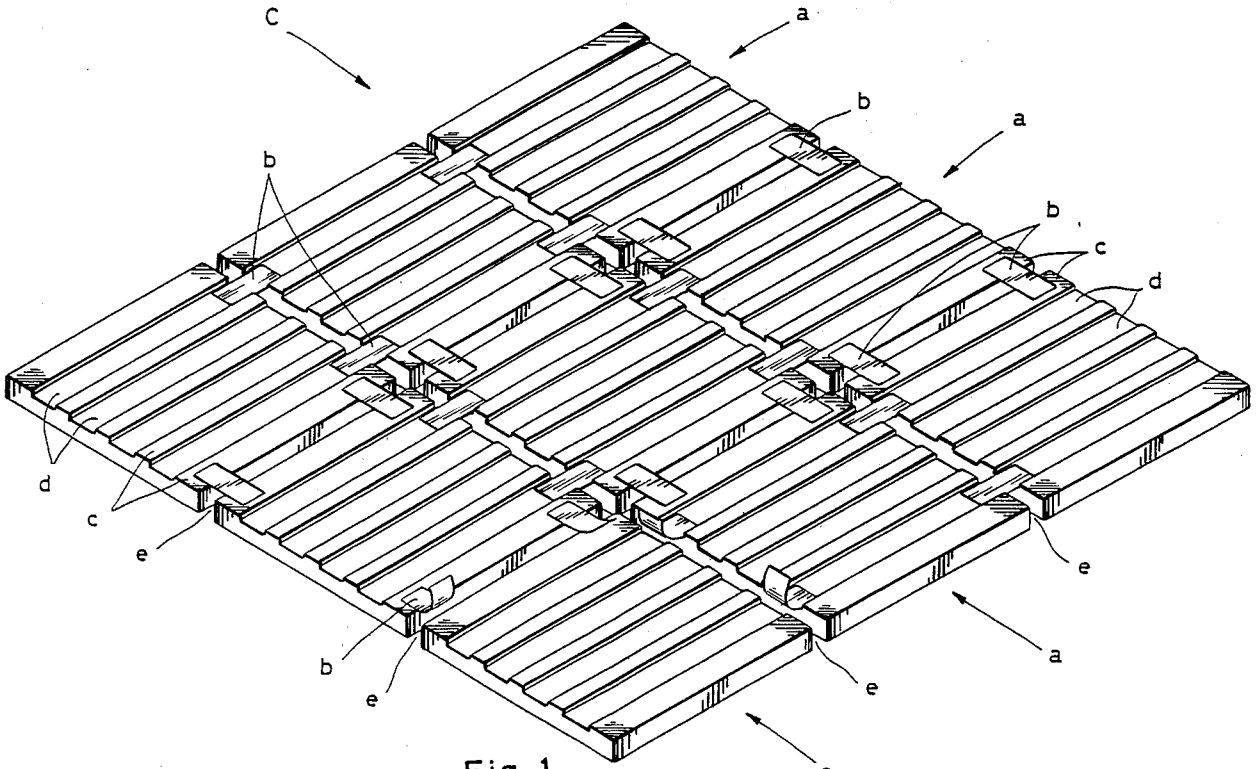
FIG. 1 is a perspective view of an embodiment of connected tiles of the present invention, showing some of the connecting pieces as partly peeled.

An embodiment of the connected tiles of the present invention shall be explained in the following with reference to FIG. 1.

Nine square ceramic tiles a each having convex streaks c and concave streaks d formed alternately on the back surface are arranged in a square of three rows in each of the longitudinal and lateral directions as contained in an arranging frame not illustrated with the back surfaces of the tiles directed upward, with the convex streaks c and concave streaks d directed in the same direction and with a jointing clearance e of a fixed width left between the tiles and the two tiles a adjacent to each other are connected with each other through connecting pieces b in two places with the clearance formed between them, thereby connected tiles C is formed.

Each connecting piece b is made by rectangularly cutting off such sheet material as tough paper, cloth or resin film, is a little smaller in the short side than the width of the concave streak d on the back surface of the tile a, is pasted within the concave streak d as directed in the lateral length in the adjacent part in the lateral direction to which the convex streaks c and concave streaks d correspond as continued in the respective lengthwise directions and is pasted to bridge the concave streaks c with each other as directed in the longitudinal length in the adjacent part in the longitudinal direction to which the convex streaks c parallelly correspond.

Figure 2:
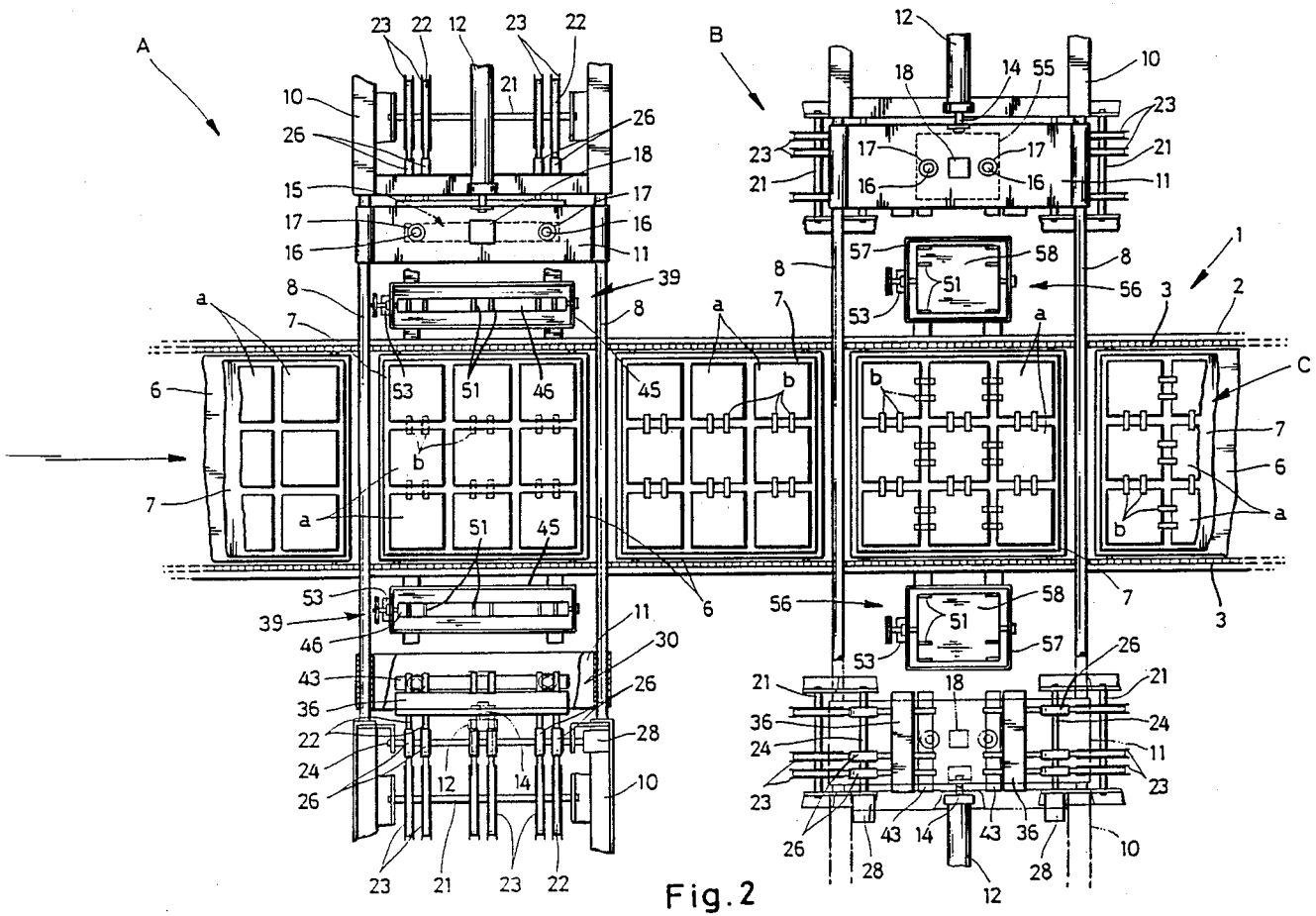
FIG. 2 is a partly sectioned plan view of an embodiment of the tile connecting apparatus of the present invention.
Figure 3:
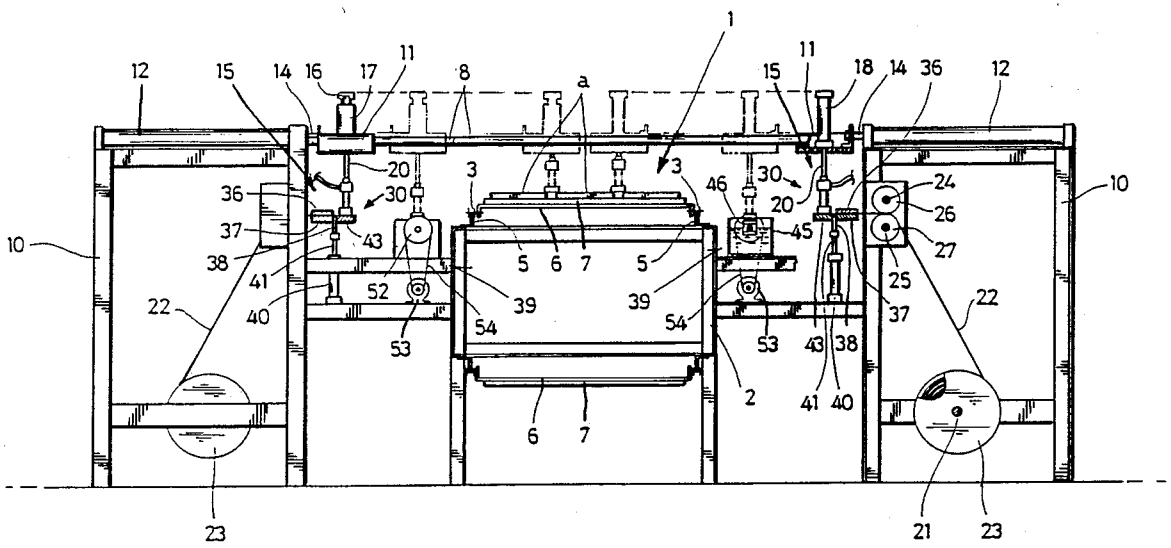
FIG. 3 is a cross-sectioned view of the same.
Figure 4:
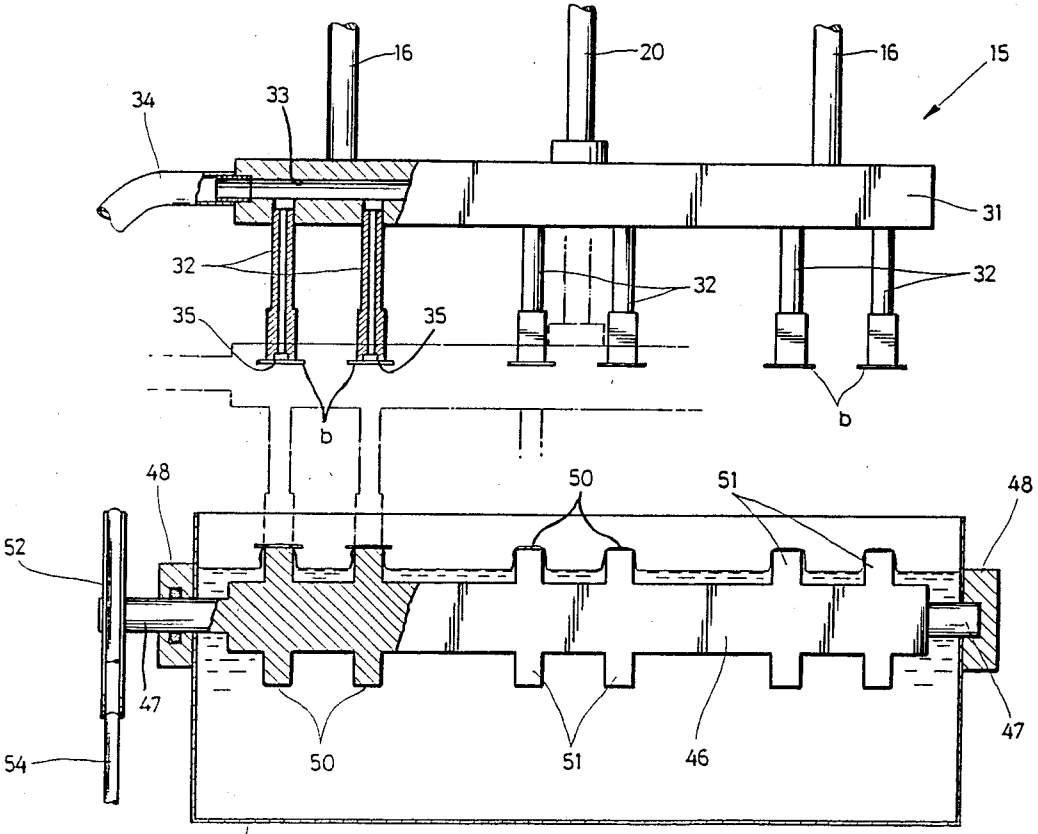
FIG. 4 is a magnified sectioned view of a part of the same.

Now, an embodiment of the apparatus for connecting tiles of the present invention shall be explained with reference to FIGS. 2 to 4 to clarify the method of connecting tiles in the explanation of the operation of the apparatus.

In the drawings, the reference numeral 1 represents a conveying line. Two chains 3 are hung in parrallel with each other between chain sprockets not illustrated supported at both front and rear ends of a frame 2 provided horizontally on a floor and the upper horizontal running parts of the chains 3 are borne by rails 5 on the upper surface of the frame 2 so as to intermittently run rightward in FIG. 2 by the intermittent rotation of chain sprockets. Many conveying plates 6 are supported with a small clearance left between each other between these two chains 3. A supporting plate 7 made of a synthetic rubber is mounted and fitted on the upper surface of each conveying plate 6. In the left end position not illustrated of the conveying line 1, nine tiles a as inverted are arranged in three rows in each of the longitudinal and lateral directions with a predetermined jointing clearance left between each other and are mounted on the upper surface of each supporting plate 7. In the first position A of the conveying line 1 which is the stopping position of each supporting plate 7, as indicated by the chain lines, two rectangular connecting pieces b are bonded onto two tiles a adjacent to each other in the lateral row direction to connect three tiles a adjacent to each other in the lateral row direction. In the front second position B, as indicated by the chain lines, the same two connecting pieces b as are mentioned above are pasted onto the tiles a adjacent to each other in the longitudinal row direction to connect three tiles a adjacent to each other in the longitudinal row direction. Thereby, the respective tiles a adjacent to one another are connected with one another to form a set of nine connected tiles C shown in FIG. 1.

Above the first position A of the conveying line 1, two guide bars 8 parallel with each other and directed at right angles to the conveying line 1 are horizontally passed and supported between frames 10 erected on both sides of the conveying line 1. Between the guide bars 8, two moving bodies 11 are fitted movably at right angles to the conveying line 1 with sliding holes at both ends fitted respectively on both guide bars 8. The respective moving bodies 11 are connected to the respective piston rods 14 of air cylinders 12 fixed as inwardly directed to each other on the upper surfaces of the respective frames 10 so as to reciprocate between above the conveying line 1 and the respective frames 10 when the air cylinders 12 are driven. Below each moving body 11, a sucking device 15 is vertically movably supported by fitting guide bars 16 fitted as directed upward on both sides of the upper surface of the sucking device 15 respectively into guide cylinders 17 fixed on the upper surface of the moving body 11 and is connected to a piston rod 20 projected from the lower surface of the moving body 11 of an air cylinder 18 fixed as directed downward on the upper surface of the moving body 11. As shown in FIG. 4, in this sucking device 15, on the lower surface of a fitting member 31 connected to the lower end of the piston rod 20, six suction tubes 32 are fitted so as to correspond respectively to the six connecting pieces b in the longitudinal row direction indicated by the chain lines in FIG. 2, communicate with an air port 33 formed in the center part of the fitting member 31 and are connected to an air sucking device not illustrated through a hose 34 and valve connected to the air port 33. At the lower end of each suction tube 32, a rectangular sucker 35 smaller in both width and length than the connecting piece b indicated by the chain lines in FIG. 2 is formed. A supporting shaft 21 parallel with the conveying direction of the conveying line 1 is supported in the lower part of each frame 10 fitted with an air cylinder 12 driving each moving body 11 and is rotatably and removably fitted with six reels 23 having wound up long paper tapes 22 in the positions corresponding respectively to the six connecting pieces b in the longitudinal row direction indicated by the chain lines in FIG. 2. In the upper part of each frame 10, rotary shafts 24 and 25 parallel with the above mentioned supporting shaft 21 are supported as vertically spaced from each other. Six feeding rollers 26 corresponding to the above mentioned six reels 23 are fixed to the upper rotary shaft 24, six contact rollers 27 rotating in contact with the respective feeding rollers 26 are fixed to the lower rotary shaft 25 and the upper rotary shaft 24 is connected to the output shaft of a servomotor 28 fixed to the frame 10 so that the respective paper tapes 22 payed out of the respective reels 23 and held between the feeding rollers 26 and contact rollers 27 may be fed out by fixed lengths toward the conveying line 1 by the feeding rollers 26 intermittently rotated by the drive of the servomotor 28. Inside the feeding rollers 26 and contact rollers 27, there is set each cutting device 30 cutting by fixed lengths off the respective paper tapes 22 fed out by these rollers. This cutting device 30 comprises a long fixed cutter 36 in the conveying direction of the conveying line 1, a guide plate 37 with a slight clearance below it and a moving cutter 38 vertically sliding on the end surface of the fixed cutter 36. The moving cutter 38 is connected to a piston rod 41 of an air cylinder 40 fixed as directed upward on the upper surface of a fitting member passed between the frames 2 and 10 so that, when the paper tapes 22 fed out by the feeding rollers 26 are passed through the clearance between the fixed cutter 36 and guide plate 37 and are fed out by fixed lengths on the upper surface of a supporting plate 43 arranged on the conveying line 1 side of the moving cutter 38, the moving body 11 will be moved to be above the cutting device 30 by the drive of the air cylinder 12, the sucking device 15 will be lowered by the drive of the air cylinder 18, the respective suckers 35 at the lower end will press the respective paper tapes 22 fed out on the upper surface of the supporting plate 43, thereby the respective paper tapes 22 will be held on the upper surface of the supporting plate 43, then the moving cutter 38 will be moved upward by the drive of the air cylinder 40 and the respective paper tapes 22 will be cut off to form the connecting pieces b.

Each painting device 39 is set between the cutting device 30 and conveying line 1. In this painting device 39, a container 45 containing a bonding agent and opened on the upper surface is supported along the conveying line 1 by a supporting member passed between the frames 2 and 10. Within this container 45, an elongated rotor 46 is rotatably supported in the shaft parts 47 at both ends as water-tightly fitted in bearings 48 secured outside the side walls of the container 45. On the upper surface and lower surface of the rotor 46, as shown in FIG. 4, six projections 51 having rectangular supporting surfaces 50 coordinated with the lower end surfaces of the respective suckers 35 of the sucking device 15 are formed to be projected to correspond to the respective suckers 35. The supporting surface 50 of each upper projection 51 projects above the liquid level of the bonding agent contained in the container 45. A pulley 52 is fixed to one shaft part 47 of the rotor 46 and is connected through a belt 54 to the output shaft of a rotary actuator 53 fixed to the fitting member below the container 45 so that, when the rotor 46 is rotated by half a rotation by the drive of the actuator 53, the upper and lower projections 51 will be alternately reversed to be above and below and the bonding agent will be deposited on the supporting surfaces 50 of the respective projections 51 projected above the liquid level of the bonding agent by the reversing.

On the other hand, also above the second position B of the conveying line 1, the same as in the above mentioned first position A, two guide bars 8 directed at right angles to the conveying line 1 are supported as horizontally passed between the frames 10 erected on both sides of the conveying line 1. Two moving bodies 11 movably fitted between these guide bars 8 are connected respectively to the piston rods 14 of the air cylinders 12 fixed to the respective frames 10. Sucking devices 55 are vertically movably supported the same as in the above mentioned sucking devices 15 on the respective moving bodies 11 with the guide bars 16 fitted in the guide tubes 17 of the moving bodies 11 and are connected respectively to the piston rods 20 of the air cylinders 18 so that, the same as is mentioned above, the respective moving bodies 11 may be reciprocated between the frames 10 and the part above the conveying line 1 by the drive of the air cylinders 12 and the respective sucking devices 55 may be moved vertically by the drive of the air cylinders 18. On both sides of the respective frames 10, the supporting shafts 21 rotatably supporting three reels 23 having wound up the paper tapes 22, the rotary shafts 24 respectively having three feeding rollers 26 fixed to them and the cutting devices 30 of the same formation as is mentioned above for cutting off three paper tapes 22 are fitted at right angles with the conveying line 1 as different respectively from the above mentioned so that, by the intermittent rotation of the servomotor 28, the paper tapes 22 of a total of six reels 23 may be fed out parallelly with the conveying line 1 toward the middle of the frames 10 and the respective paper tapes 22 fed out may be fed out onto the upper surfaces of the supporting plates 43 on both sides so as to be in the positions corresponding to the arrangement of six connecting pieces b of 12 connecting pieces b indicated by the chain lines on the tiles a on the supporting plate 7 stopped in the second position B as divided by 2 in the width direction of the conveying line 1. On the other hand, in the above mentioned sucking device 55 fitted below the moving body 11, the same six suction tubes 32 as are mentioned above are so arranged that the respective suckers 35 at the lower ends may correspond to the respective paper tapes 22 fed out onto the supporting plates 43, the same as is mentioned above, the sucking device 55 may lower from the moving body 11 having moved to be above the cutting device 30, the respective suckers 35 of the suction tubes 32 may press and hold the respective paper tapes 22 on the supporting plates 43 and then the respective moving cutters 38 of the cutting devices 30 may move upward to form six connecting pieces b. The same bonding agent painting devices 56 as are mentioned above are provided respectively between the cutting devices 30 and the conveying line 1. A rotor 58 supported within a container 57 containing a bonding agent is wider than the above mentioned rotor 46. The same six projections 51 as are mentioned above are formed to project on both upper and lower surfaces of the rotor 58 so as to be arranged the same as in the respective suckers 35 of the sucking device 55. The same as in the above, by the drive of the rotary actuator 53, the rotor 58 will be rotated by half a rotation so that the supporting surfaces 50 of the respective upper projections 51 will project above the liquid level of the bonding agent.

The operation of this embodiment shall be explained in the following.

When the intermittently running supporting plate 7 stops in the first position A, the respective paper tapes 22 payed out of the reels 23 by the feeding rollers 26 on both sides will be pressed against the supporting plates 43 by the respective suckers 35 fitted at the lower ends of the sucking devices 15 having lowered from the moving body 11 which had been waiting above and then will be cut off to form six connecting pieces b by the upward movement of the moving cutters 38. Then the valve will operate, the respective suckers 35 of the sucking devices 15 will suck in air and the respective connecting pieces b will be sucked and held on the lower surfaces of the respective suckers 35. Then, as indicated by the chain lines in FIG. 3, the respective moving bodies 11 will move to be above the painting devices 39, the sucking devices 15 will lower, the connecting pieces b held by the respective suckers 35 will be pressed against the supporting surfaces 50 of the respective projections 51 projecting above the liquid level of the bonding agent of the rotor 46 turned before and thereby the respective connecting pieces b will be painted on the lower surfaces with the bonding agent deposited on the supporting surfaces 50 of the respective projections 51. Here, as the supporting surfaces 50 of the respective projections 51 are smaller in the widths and lengths than the connecting pieces b as mentioned above, the respective connecting pieces b will be painted with the bonding agent on the lower surfaces only somewhat inside the outer peripheral edges. Then, the sucking devices 15 will move upward, the respective moving bodies 11 will move upward of the conveying line 1 and the sucking devices 15 will again lower. Thereby, as indicated by the chain lines in FIG. 3, the connecting pieces b held by the suckers 35 of the sucking device 15 on the left side will be pasted onto the upper surfaces of the adjacent parts of the tiles a in the lateral row direction in the middle and on the left side and the connecting pieces b held by the suckers 35 of the sucking device 15 on the right side will be pasted onto the upper surfaces of the adjacent parts of the tiles a in the lateral row direction in the middle and on the right side. When the pasting of the connecting pieces b thus ends, by the operation of the valve, the suction of air by the respective suckers 35 will end. Then, the sucking devices 15 will move upward and both moving bodies 11 will return to be above the respective cutting devices 30 and will wait. Thus, in the first position A, two connecting pieces will be pasted respectively onto adjacent tiles a in the lateral row direction on the supporting plate 7 so as to connect the adjacent tiles a with each other in the lateral row direction. On the other hand, in the second position B, by the same operations as are mentioned above of the moving bodies 11 and sucking devices 55, six connecting pieces b cut off by the cutting devices 30 will be sucked and held respectively by the suckers 35 of the sucking devices 55 on both sides, will be painted with the bonding agent the same as are mentioned above by the painting devices 56, will be shifted on the conveying line 1 and will be pasted onto the upper surfaces of the adjacent parts of the adjacent tiles a in the longitudinal row direction to connect the adjacent tiles a with each other in the longitudinal row direction as indicated by the chain lines. Thereby, nine tiles a will be integrally connected with one another longitudinally and laterally to form connected tiles C.

In this embodiment, the connecting pieces b are painted with the bonding agent on the lower surfaces only a little inside the outer peripheral edges. Therefore, there is an advantage of preventing the connecting pieces b from being pasted onto the suckers 35 by the bonding agent protruded out of the connecting pieces b and deposited on the lower surfaces of the suckers 35 when they are to be pasted onto the tiles a. Also, as the work of connecting the adjacent tiles a with each other in the longitudinal row direction and the work of connecting the adjacent tiles a with each other in the lateral row direction are made respectively in the different positions, there is an advantage that the structure of the apparatus is simple.

By the way, in this embodiment, the connecting pieces b are formed by cutting off the paper tapes 22 and are then painted with the bonding agent. However, the paper tapes 22 may be painted with the bonding agent in the step before being cut off and then may be cut off to form the connecting pieces b. Also, the paper tapes 22 may be painted in advance with a water-soluble bonding agent, may be dried and may be wet with water to produce a bonding force just after they are payed out of the reels 23 or after they are cut off. Further, instead of painting the connecting pieces b or paper tapes 22 with the bonding agent, the tiles a may be painted with the bonding agent in the bonding positions on the back surfaces.

What is claimed is:

1. Apparatus for producing sets of connected tiles, comprising means for conveying a plurality of adjacent tiles arranged as a set, means for supplying long tape-shaped connecting material, means for severing from said tape-shaped material a plurality of connecting pieces of predetermined length, means for applying said connecting pieces to said tiles in position to bridge adjacent tiles, with a bonding agent between said connecting pieces and said tiles, thereby interconnecting said tiles as a set, said applying means comprising suction means for sucking up said connecting pieces, transporting said connecting pieces to said tiles and pressing said connecting pieces on said tiles, and means for applying said bonding agent to said connecting pieces while held by said suction means, said means for applying said bonding agent to said connecting pieces comprising an open top container for a liquid bonding agent, a rotor rotatable about a substantially horizontal axis and having projections of a shape corresponding to the shape of said connecting pieces, said projections being moved, by rotation of said rotor, between a first position in said liquid bonding agent and an upwardly facing second position above said liquid bonding agent, said suction means pressing said connecting pieces on said projections when in said second position to apply said liquid bonding agent to said connecting pieces.

2. Apparatus according to claim 1, in which said projections are slightly smaller than said connecting pieces to leave on said connecting pieces a margin free of said liquid bonding agent.

3. Apparatus according to claim 1, in which said conveying means comprises a plurality of supporting plates, each of a size and shape to support a set of tiles.

4. Apparatus for producing sets of connected tiles, comprising means for conveying a plurality of adjacent tiles arranged as a set, means for supplying long tape-shaped connecting material, means for severing from said tape-shaped connecting material a plurality of connecting pieces of predetermined length, means for applysaid connecting pieces to said tiles in position to bridge adjacent tiles, with a bonding agent between said connecting pieces and said tiles, thereby interconnecting said tiles as a set, said means for applying said connecting pieces to said tiles comprising means for applying connecting pieces disposed lengthwise with respect to a direction of movement of said tiles by said conveying means and for also applying connecting pieces disposed crosswise with respect to the direction of movement of said tiles by said conveying means, said tiles being moved successively between a first work station and a second work station, and said connecting pieces applied at said first work station being oriented in one direction and said connecting pieces applied at said second work station being oriented in another direction.

5. Apparatus for producing sets of connected tiles, comprising means for conveying a plurality of adjacent tiles arranged as a set, means for supplying long tape-shaped connecting material, means for severing from said tape-shaped connecting material a plurality of connecting pieces of predetermined length, means for applying said connecting pieces to said tiles in position to bridge adjacent tiles, with a bonding agent between said connecting pieces and said tiles, thereby interconnecting said tiles as a set, said applying means comprising guide rails extending transversely above said conveying means, a carriage running on said guide rails and suction means on said carriage for sucking up said connecting pieces and transporting them to a position over said conveying means.

6. Apparatus according to claim 5, in which said means for supplying long tape-shaped connecting material comprises means for supporting a plurality of reels of said material, and in which said severing means comprises means for severing said connecting pieces from each of said reels.

7. Apparatus according to claim 6, in which said applying means comprises means for receiving connecting pieces severed from each of said reels and simultaneously applying said connecting pieces to said tiles.

* * * * *